United States Patent [19]

Peel

[11] Patent Number: 5,029,780

[45] Date of Patent: Jul. 9, 1991

[54] MULTI-FREQUENCY RAILROAD GRADE CROSSING TERMINATION SHUNT ASSEMBLY

[75] Inventor: Richard V. Peel, Upland, Calif.

[73] Assignee: Safetran Systems Corporation, Minneapolis, Minn.

[21] Appl. No.: 522,667

[22] Filed: May 14, 1990

[51] Int. Cl.[5] ..... B61L 29/22; H03H 7/00

[52] U.S. Cl. ..... 246/127; 246/34 R; 333/174; 333/175

[58] Field of Search ..... 246/34 R, 34 A, 34 CT, 246/40, 114 R, 114 A, 125, 126, 127, 128, 130; 361/270; 333/174, 175, 182, 219

[56] References Cited

U.S. PATENT DOCUMENTS

| | | | |
|---|---|---|---|
| 2,129,293 | 9/1938 | Weber | 333/174 |
| 2,506,971 | 5/1950 | Robinson | 361/270 X |
| 3,566,312 | 2/1971 | McDonald | 333/174 |
| 3,752,426 | 8/1973 | Pal | 246/40 X |
| 3,777,139 | 12/1973 | Peel | 246/125 |
| 3,944,173 | 3/1976 | Moe et al. | 246/128 X |
| 3,952,977 | 4/1976 | Yermeulen | 246/34 R X |
| 3,955,785 | 5/1976 | Yermeulen et al. | 246/40 X |
| 3,977,634 | 8/1976 | Smith | 246/125 X |
| 4,324,376 | 4/1982 | Kuhn | 246/34 A X |
| 4,453,145 | 6/1984 | Schuster | 333/174 |

*Primary Examiner*—Robert J. Spar
*Assistant Examiner*—Scott L. Lowe
*Attorney, Agent, or Firm*—Kinzer, Plyer, Dorn, McEachran & Jambor

[57] ABSTRACT

A multi-frequency shunt is provided for use between the rails of a railroad track to define the approach distance for a railroad crossing using a constant warning time or motion detection device. The shunt includes a housing with a PC board having rail terminals thereon being mounted in the housing. There are connections from the rail terminals of the PC board, extending outwardly through the housing, to the rails. The PC board includes a plurality of inductive and capacitive elements mounted thereon and connected to header terminals which are mounted on a header board. There are straps for interconnecting the header terminals with the interconnections between the header terminals determining which inductive and capacitive elements are connected between the rails and thus determining the nominal frequency of the shunt. There is a removable cover on the housing which permits access to the header board and the header terminals to provide for changing the nominal frequency of the shunt to correspond to the output frequency of the grade crossing predictor.

6 Claims, 2 Drawing Sheets

MULTI-FREQUENCY RAILROAD GRADE CROSSING TERMINATION SHUNT ASSEMBLY

SUMMARY OF THE INVENTION

The present invention relates to a variable frequency shunt for use at a railroad grade crossing.

A primary purpose of the invention is a shunt for the use described which ma have its frequency changed without removing the shunt and its attachment to the rails.

Another purpose is a shunt for use with a grade crossing predictor which may have its nominal frequency changed with a minimum of effort and without removing the shunt from its installed position within the railroad ballast and between the rails.

Another purpose is a simply constructed reliably operable shunt used to define the approach distance of a railroad crossing using a grade crossing predictor, which shunt has a removable cover permitting easy access to the straps which are used to determine the nominal frequency of the shunt.

Other purposes will appear in the ensuing specification, drawings and claims.

BRIEF DESCRIPTION OF THE DRAWINGS

The invention is illustrated diagrammatically in the following drawings wherein.

BRIEF DESCRIPTION OF THE PREFERRED EMBODIMENT

Most railroad crossing gates, under present practice, are controlled by a grade crossing predictor which is operable to sense the presence of a train within a defined approach to the crossing and to cause the gates to be lowered when the train is a certain distance from the crossing, which distance will depend upon the speed at which the train is approaching. The grade crossing predictor applies an electric signal of a specific frequency to a track circuit which includes the rails and a shunt between the rails with the shunt determining the approach distance to the crossing. In order to distinguish between individual crossings and particularly in an area where there are overlapping approaches, each grade crossing predictor operates at a specific frequency. In the past, the grade crossing predictor was set up for a specific frequency at the factory and the shunt which operated with the predictor to define the approach was set for the same frequency. If it was desired to change the frequency of the predictor, the shunt also had to be changed and this required the shunt to be dug up from its position in the ballast between the rails, removed and replaced by a shunt of a different frequency. Such shunts cost anywhere from $300–$500, and considering the labor involved in removing the shunt from the ballast and replacing it with a new shunt of a different frequency, the entire operation was expensive.

In present day practice, grade crossing predictors have programmable frequencies such that a specific predictor may be programmed for any one of a large number of frequencies. However, a change in the predictor frequency still requires a change in the specific shunt for the approach to that predictor. The present invention provides a shunt for the use described which has the capability of being set for a number of different frequencies. The shunt has a plurality of inductors and capacitors, the interconnection of which will determine the nominal frequency of the shunt, and these individual circuit elements are each connected to a header terminal. The frequency for a shunt is determined by the strapping between the header terminals and a change in this strapping may be done in the field, eliminating the necessity of replacing the entire shunt.

Figure 1:
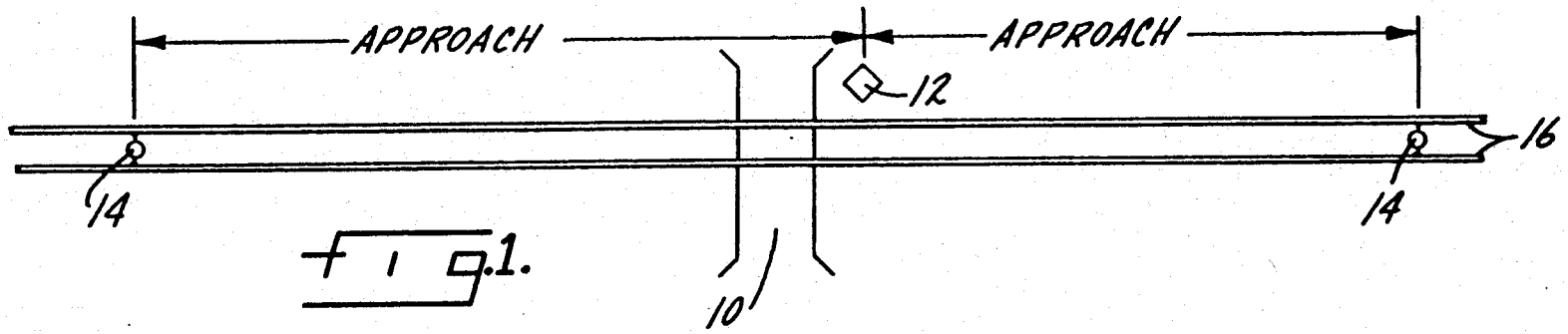
FIG. 1 is a diagrammatic illustration of a railroad crossing, and the approach distances thereto as defined by the variable shunt of the present invention.

In the drawings, specifically FIG. 1, a railroad crossing is indicated at 10 and there is a grade crossing predictor indicated diagrammatically at 12. There are approaches to each side of the crossing 10 and the approach distance in each case is determined by a shunt indicated at 14 with the shunt being connected between the rails 16, as is conventional in railroad practice.

Figure 2:
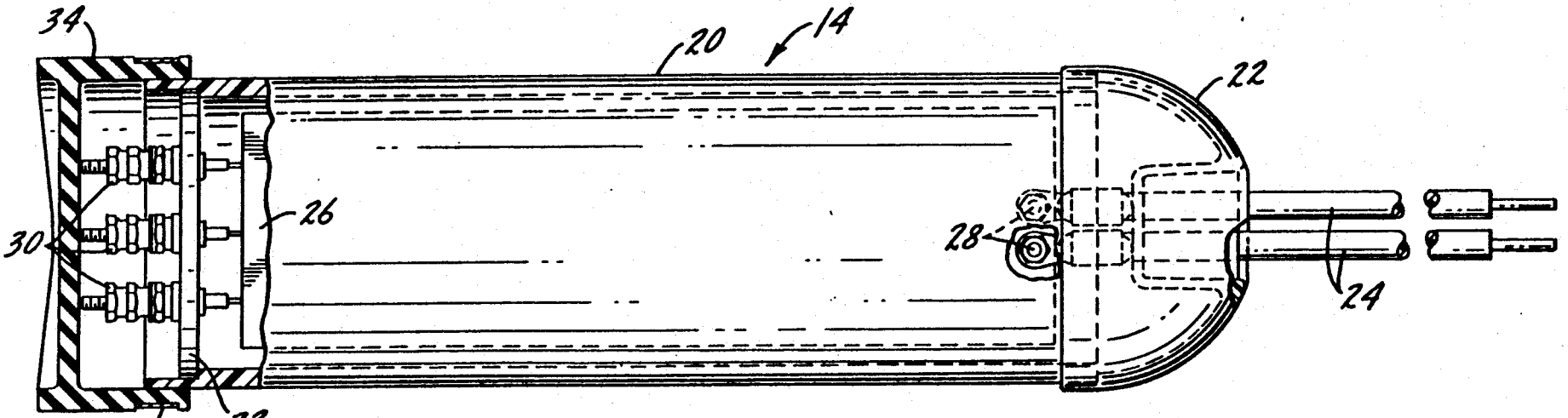
FIG. 2 is a side view, in partial section, illustrating the variable frequency railroad shunt of the present invention.

FIG. 2 illustrates the mechanical configuration of the variable shunt of this invention. The shunt includes an outer housing 20 which has a cap 22 at one end through which extends a pair of electrical wire connectors 24, each of which will be connected to one of the rails.

Within housing 20 there is a printed circuit board 26 which has a pair of rail terminals 28 at one end which terminals are connected to wire connectors 24. As will be described in connection with FIGS. 3, 4 and 5, PC board 26 mounts a plurality of inductors and capacitors which are used to determine the nominal frequency of the shunt. These elements are connected to a plurality of header terminals 30 each of which are mounted on a header board 32 positioned in one end of housing 20. Header terminals 30 are enclosed by a cover 34 which may be formed of a rubber or rubberlike material so as to seal the interior of housing 20 from the elements. Cover 34 is held in place on the open end of housing 20 by a removable strap 36.

In use, the shunt will be buried in the ballast between the rails and connectors 24 will be connected to adjacent rails. There will be straps connecting certain designated header terminals which will determine the nominal frequency of the shunt. Once the shunt is fixed in place between the rails, if it is necessary to change the frequency of the shunt, strap 36 is removed, as is cover 34, permitting access to header terminals 30. The strapping on the terminals is changed so as to provide whatever frequency is desired for the shunt. The cover and strap are then replaced so that the unit is again sealed from the elements.

Figure 3:
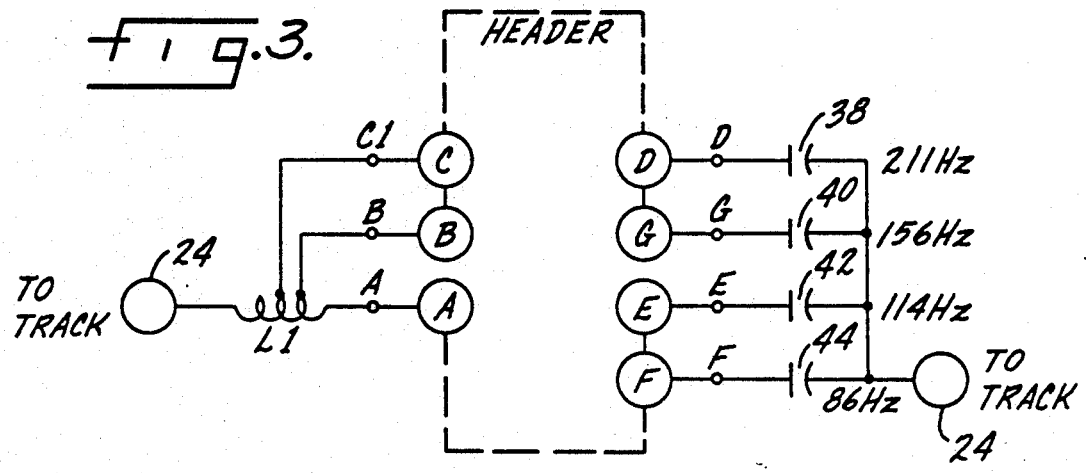
FIG. 3 is a wiring diagram of one form of variable frequency shunt.
Figure 4:
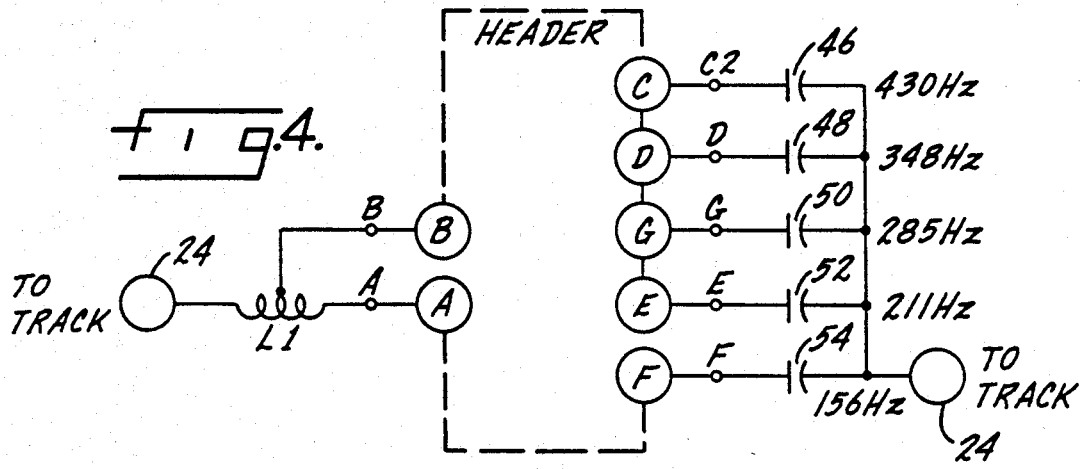
FIG. 4 is a wiring diagram of a second form of variable frequency shunt.
Figure 5:
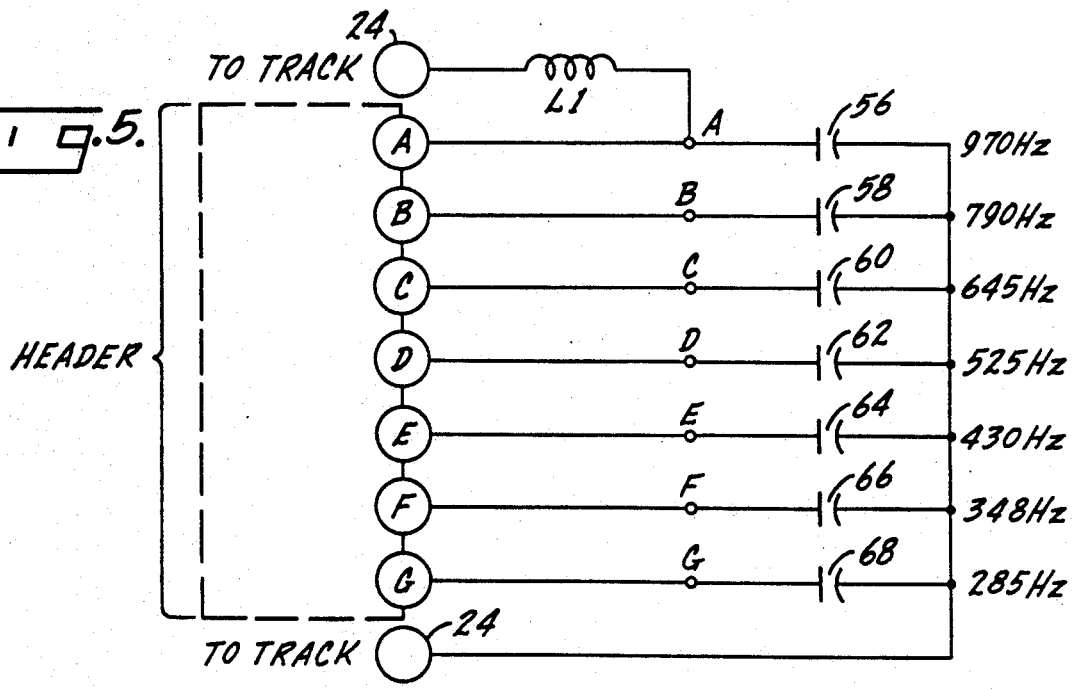
FIG. 5 is a wiring diagram of yet a further form of variable frequency shunt.

FIGS. 3, 4 and 5 show three different arrangements of inductors and capacitors which can be used to provide three different ranges of frequency for the shunt. The FIG. 3 embodiment shows a low frequency shunt; the FIG. 4 embodiment an intermediate frequency shunt; and the FIG. 5 embodiment a high frequency shunt.

Looking specifically at FIG. 3, one track connector 24 is connected to coil L1 which has two intermediate taps indicated at B and Cl with the three coil terminals being connected to header terminals designated at A, B, C. The other track terminal 24 is connected to the common end of four capacitors indicated at 38, 40, 42 and 44. These capacitors are connected, respectively, to header terminals D, G, E and F. The four output frequencies for the circuit of FIG. 3, indicated at the right side of the capacitors, are 86 Hz, 114 Hz, 156 Hz and 211 Hz. To provide an 86 Hz output there will be connections between header terminals A-D; D-G; G-E; and E-F. For an output of 114 Hz there will be connections between header terminals B-D; D-G; and G-E. For an output frequency of 156 Hz there will be connections between header terminals C-D; and D-G. For an output frequency of 211 Hz there is only a connection between terminals C-D.

In FIG. 4 track connector 24 is again connected to coil L1, although in this instance there is only one intermediate tap with the result that the coil had two header terminals indicated at A and B. There are five capacitors indicated at 46, 48, 50, 52 and 54 which, when connected in combination with coil terminals A and B will provide output frequencies of 156 Hz; 211 Hz; 285 Hz; 348 Hz and 430 Hz. The interconnections between the header terminals to provide the designated output frequencies are as follows: For 156 Hz: connect terminals A-C; C-D; D-G; GE; and E-F. For 211 Hz: connect terminals A-C; C-D; D-G; and GE. For 285 Hz: connect terminals B-C; C-D; D-G. For 348 Hz: connect terminals B-C; and C-D. For 430 Hz: connect terminals B-C.

In the FIG. 5 high frequency embodiment there is a single coil having a connection at header terminal A and there are capacitors 56, 58, 60, 62, 64, 66 and 68. The connections between the header terminals to provide the output frequencies are as follows: For 285 Hz: connect terminals A-B; B-C; C-D; D-E; E-F; and F-G. For 348 Hz: connect terminals A-B; B-C; CD; D-E; and E-F. For 430 Hz: connect terminals A-B; B-C; C-D; and D-E. For 525 Hz: connect terminals A-B; B-C; and C-D. For 645 Hz: connect terminals A-B; and B-C. For 790 Hz: connect terminals A-B. For 970 Hz there are no interconnections required which will result in coil L1 and capacitor 56 being in circuit between the two rail connections.

Although specific frequencies and specific strapping arrangements between header terminals have been disclosed herein, the invention should not be so limited. What is important is to provide a variable frequency shunt in which a combination of inductive and capacitive elements are interconnected so as to provide variable output frequencies for the shunt, the frequency depending upon the specific interconnections between the elements.

Whereas the preferred form of the invention has been shown and described herein, it should be realized that there may be many modifications, substitutions and alterations thereto.

The embodiments of the invention in which an exclusive property or privilege is claimed are defined as follows:

1. A variable frequency railroad shunt between the rails of a railroad track to define the approach distance for a railroad crossing using a grade crossing predictor, said shunt including a housing, a PC board mounted in said housing and having rail terminals thereon, wire connections attached to said terminals at one of their ends and extending outwardly through said housing and attached to the rails at their other ends, said PC board including a plurality of inductive and capacitive elements mounted thereon and connected to header terminals, straps for interconnecting said header terminals with the interconnections between said header terminals determining which inductive and capacitive elements are connected between the rails which determines a nominal frequency of the shunt, and a removable cover on said housing providing access to said header terminals to permit for changing the nominal frequency of said shunt to correspond with the frequency of said grade crossing predictor.

2. The variable frequency shunt of claim 1 further characterized in that said cover is formed of a rubberlike material.

3. The shunt of claim 2 further characterized by and including a removable strap extending about the exterior of said rubberlike cover for securing said cover to said shunt housing.

4. The shunt of claim 1 further characterized in that at least one of said header terminals is connected to an inductive element.

5. The shunt of claim 1 further characterized in that there are a plurality of capacitive elements on said PC board, with each of said capacitive elements being connected to a different header terminal.

6. The shunt of claim 1 further characterized in that one of said rail terminals is connected to an inductive element, each of said capacitive elements having one side thereof connected to a header terminal and the other side thereof connected, in common, to said other rail terminal.

* * * * *